US005219193A

United States Patent [19]

Piltingsrud

[11] Patent Number: 5,219,193

[45] Date of Patent: Jun. 15, 1993

[54] FORCED ENTRY RESISTANT CHECK RAIL LOCK

[75] Inventor: Stephen M. Piltingsrud, Owatonna, Minn.

[73] Assignee: Truth Division of SPX Corporation, Owatonna, Minn.

[21] Appl. No.: 886,828

[22] Filed: May 22, 1992

[51] Int. Cl.[5] ..... E05C 3/04

[52] U.S. Cl. ..... 292/240; 292/106

[58] Field of Search ..... 292/240, 241, 242, 190, 292/106, 207, DIG. 6

[56] References Cited

U.S. PATENT DOCUMENTS

| | | | |
|---|---|---|---|
| 2,603,515 | 7/1952 | Thomas | 292/207 |
| 2,830,843 | 4/1958 | Seaburg et al. | 292/241 X |
| 3,109,675 | 11/1963 | Anderson | 292/109 |
| 3,161,923 | 12/1964 | Crain | 20/52 |
| 3,394,955 | 7/1968 | Martin | 292/113 |
| 3,560,037 | 2/1971 | Crain | 292/170 |
| 3,706,467 | 12/1972 | Martin | 292/111 |
| 3,907,348 | 9/1975 | Bates et al. | 292/207 X |
| 3,911,718 | 9/1975 | Bates | 292/241 |
| 3,949,525 | 4/1976 | Bates et al. | 49/395 |
| 3,951,444 | 4/1976 | Shull | 292/204 X |
| 4,059,298 | 11/1977 | Van Klompenburg | 292/199 |
| 4,095,827 | 6/1978 | Stavenau | 292/65 |
| 4,095,829 | 6/1978 | Van Klompenburg | 292/241 |
| 4,155,575 | 5/1979 | Poe | 292/190 |
| 4,261,602 | 4/1981 | Anderson | 292/143 |
| 4,389,062 | 6/1983 | Rosenberg | 292/241 X |
| 4,429,910 | 2/1984 | Anderson | 292/199 |
| 4,497,135 | 2/1985 | Vetter | 49/280 |
| 4,610,472 | 9/1986 | Billingsley | 292/54 |
| 4,621,847 | 11/1986 | Paulson et al. | 292/199 |
| 4,736,972 | 4/1988 | Mosch | 292/241 X |
| 4,801,164 | 1/1989 | Mosch | 292/204 |
| 4,813,725 | 3/1989 | Mosch | 292/241 |
| 4,937,976 | 7/1990 | Tucker et al. | 49/345 |
| 4,991,886 | 2/1991 | Nolte et al. | 292/161 |
| 5,054,239 | 10/1991 | Tucker et al. | 49/279 |
| 5,087,087 | 2/1992 | Vetter et al. | 292/48 |
| 5,110,165 | 5/1992 | Piltingsrud | 292/242 |
| 5,118,145 | 6/1992 | Tucker | 292/158 |

OTHER PUBLICATIONS

Allen-Stevens Brochure for "Keyless Push Button Security Lock" 1 sheet; Sep. 1991 "Series 9600".

Truth Brochure for "Entrygard Sash Lock" (1991) pp. 11-11a 1 sheet; ©1991 cites U.S. Pat. No. 4,621,847.

Truth Brochure for "Non-Handed, Low Profile Sash Lock" (1991) pp. 12a-12b 12-12c cites U.S. Pat. No. 4,059,298; Canada No. 1,072,148.

Truth Brochure for "Sash Lock" (1991) pp. 13-13a.

Truth Brochure for "Concealed Casement Hardware-Lock" (1991) pp. 13.1; 13.1b; 13.1a.

Truth Brochure for "Entrygard Cam Lock" (1991) pp. 14-14a.

(List continued on next page.)

*Primary Examiner*—Richard E. Moore

*Attorney, Agent, or Firm*—Wood, Phillips, VanSanten, Hoffman & Ertel

[57] ABSTRACT

A check rail lock with a handle pivot shaft secured for pivotal movement with respect to the housing and a cam which pivots with the shaft between an open position with the cam enclosed in the housing and a locking position with the cam extending from the housing for grasping a keeper. An axially reciprocable locking member is associated with the pivot shaft for pivoting therewith, and has a manually engageable button end projecting above the housing and a locking end within the housing. The locking end has circumferentially spaced locking surfaces, and a spring biases the member locking end into engagement with the housing. First and second locking notches in the housing receive the member locking end when the cam and handle are in the open and locking positions, respectively, and the locking notches each have a surface engaging one of the locking end locking surfaces to prevent pivoting of the locking member and pivot shaft when the member locking end is received therein.

16 Claims, 1 Drawing Sheet

OTHER PUBLICATIONS

Truth Brochure for "Trimline Cam Lock" (1991) pp. 15-15a.

Truth Brochure for "Flush Mount Check Rail Lock" (1991) pp. 15.1-15.1A.

Truth Brochure for "Check-Rail Locks" (1991) pp. 16-16a.

Truth Brochure for "Low Profile Cam Lock" (1991) pp. 17-17a.

Truth Brochure for "Cam Lock" (1991) pp. 18-18a.

Truth Brochure for "Trimline Cam Lock" (1988) pp. 12; 12c; 12a; 12b.

Truth Brochure for "Locking Handle" (1988) pp. 14; 14e; 14a; 14b; 14c; 14d.

Truth Brochure for "Trimline Cam Handle Locks" (1988) pp. 15; 15c; 15a; 15b.

Truth Brochure for "Non-Handed, Low Profile Sash Lock" (1988) pp. 15-15a cites U.S. Pat. No. 4,059,298; Canada No. 1072148.

Truth Brochure for "Multi-Point Locking System" (1989) p. 20.1; 20.1e; 20.1a; 20.1b; 20.1c; 20.1d.

FORCED ENTRY RESISTANT CHECK RAIL LOCK

BACKGROUND OF THE INVENTION

1. Technical Field

The present invention is directed toward a check rail lock for use with a double-hung window, and more particularly toward a check rail lock including a handle and cam which are lockable in both the open and closed positions.

2. Background Art

A check rail lock draws together meeting rails of an upper and lower sash of a double-hung window and locks the sashes against opening movement. The check rail lock has a housing which mounts a rotatable cam for movement between locked and unlocked positions and which engages a keeper in a locked position The cam is limited to movement between the locked and unlocked positions.

Some prior art cam locks have included a spring washer rotatable with a cam and a coacting detent structure on the spring washer and the housing which releasably retains the cam in either locked or unlocked positions. However, it is possible to cause such check rail locks to open by operating the handle with a stiff wire from outside the window. Thus, an intruder can gain access through the double-hung window.

Still other cam locks have provided a mechanism for locking the handle and cam in the locked position in order to keep an intruder from opening the lock from the outside by manipulating the lock with a wire or other tool inserted between the sashes or through a security grate over the window. However, such prior art locks have been freely movable when not in the locked position, with the result being that the lock when opened can be inadvertently moved toward the closed position with the cam extending out of the housing. In such a condition, which will typically not be noticed by a person thereafter moving the window, movement of the window can cause the cam to hit the keeper, grill bars or other obstructions and break the check rail lock or window.

The present invention is directed toward overcoming one or more of the problems set forth above.

SUMMARY OF THE INVENTION

In one aspect of the present invention, a check rail lock is provided having a housing, a handle with a pivot shaft extending through the housing and secured for pivotal movement with respect to the housing, and a cam fixed for pivoting with the shaft. The handle and cam are pivotable together between an open position with the cam enclosed in the housing and a locking position with the cam extending from the housing for grasping a keeper. An axially reciprocable locking member is associated with the pivot shaft for pivoting therewith, and has a manually engageable button end projecting above the housing and a locking end within the housing. The locking end has circumferentially spaced locking surfaces, and a spring biases the member locking end into engagement with the housing. First and second locking notches in the housing receive the member locking end when the cam and handle are in the open and locking positions, respectively, and the locking notches each have a surface engaging one of the locking end locking surfaces to prevent pivoting of the locking member and pivot shaft when the member locking end is received therein.

In another aspect of the present invention, the locking surfaces and the notch surfaces are each substantially parallel to the axis of rotation of the shaft.

It is an object of the present invention to provide a window lock which can be easily and inexpensively manufactured, assembled, and installed.

It is another object of the present invention to provide a window lock which can be easily operated by a proper user at all times.

It is yet another object of the present invention to provide a window lock which will provide the maximum security possible against an attempted intruder.

It is still another object of the present invention to provide a window lock which will not inadvertently damage the other window components and will not itself be inadvertently damaged during typical use either.

DESCRIPTION OF THE PREFERRED EMBODIMENT

Figure 1:
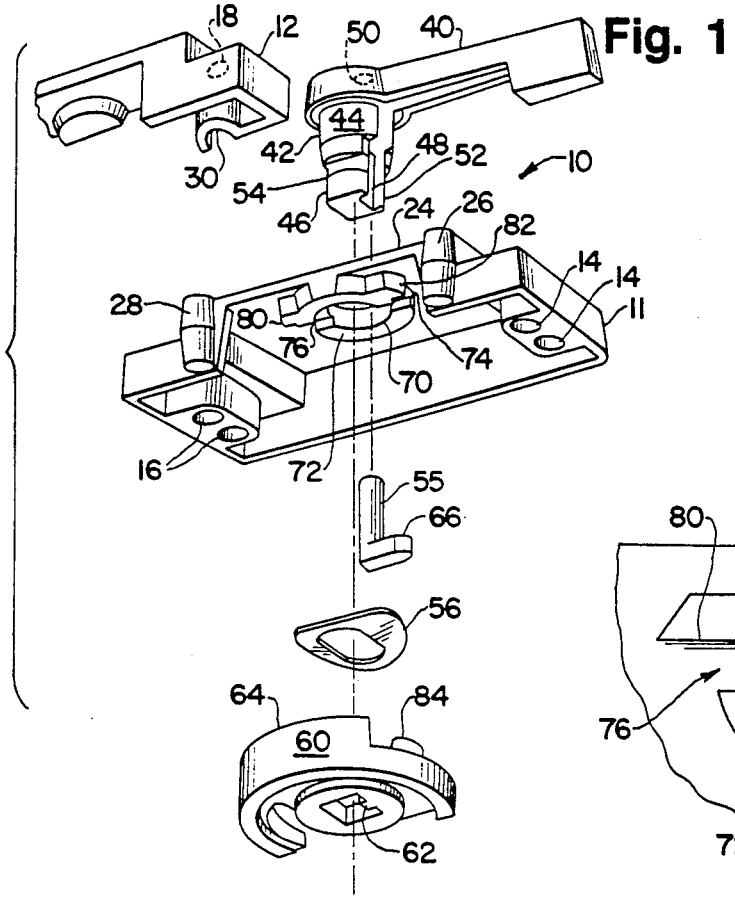
FIG. 1 is a perspective exploded view of the check rail lock.
Figure 2:
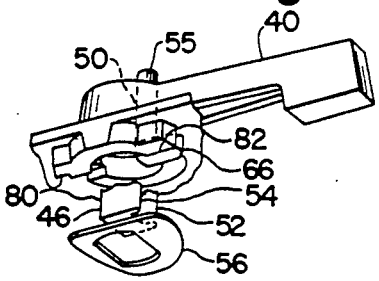
FIG. 2 is a perspective exploded fragmentary view of the handle housing and wave spring.
Figure 3:
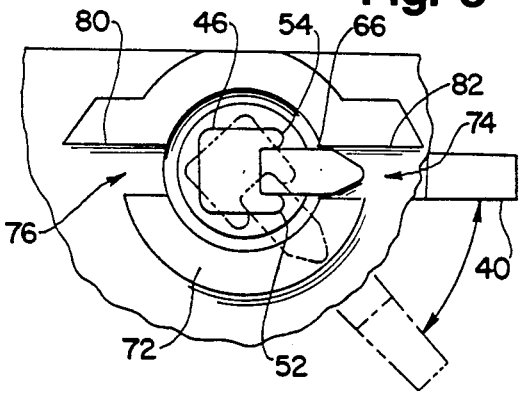
FIG. 3 is a bottom plan view of the partially assembled check rail lock housing.

A check rail lock 10 embodying the present invention is shown in FIG. 1 with a suitable keeper 12 such as is known in the art.

As is typical with check rail locks, the lock 10 includes a housing 11 (viewed from the underside in FIG. 1) which is to be suitably is mounted on a meeting rail (not shown) of a lower sash of a double-hung window and the keeper 12 is to be suitably mounted in alignment therewith on a meeting rail (not shown) of an upper sash. Such mounting can be accomplished by any suitable fastening means, such as screws (not shown) extending through openings 14 and 16 of the housing 11 and openings 18 of the keeper 12.

The housing 11 has a top wall 24 and an outer face with a pair of vertically-extending contoured lugs 26 and 28 which engage a pair of similarly-shaped recesses 30 on an inner face of the keeper 12. These lugs 26 and 28 and recesses 30 help to maintain the housing 11 and keeper 12 in alignment when the meeting rails are together with the double-hung window closed.

A handle 40 includes a downwardly depending integral shaft 42 with a generally cylindrical section 44 and a rectangular section 46 at the lower end thereof. A non-cylindrical groove 48 extends axially through the shaft 42 to an opening 50 in the top of the handle 40. The groove 48 is disposed between first and second lugs 52, 54 in the rectangular section 46.

A push button locking member 55 is disposed in the groove 48 with its upper button end projecting up through the opening 50 from the top of the handle 40. The locking member 55 is non-cylindrical to match the groove 48 so that is may slide vertically within the groove 48 without rotating therein. Of course, any non-cylindrical cross-section of the groove 48 and locking member 55 which would provide such operation would be suitable.

Figure 4:
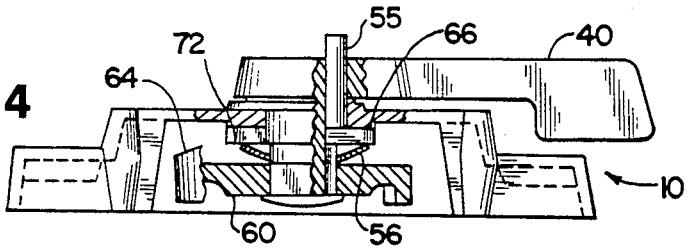
FIG. 4 is a partially broken elevation view of the check rail housing and associated structure with the cam in a locked position and broken away.

A spring washer or wave spring 56 is disposed over the handle rectangular section 46, as is the lock cam 60. When in an unbiased state, the wave spring 56 has a concave, C-shaped cross-section, as best seen in FIG. 4.

Both the wave spring 56 and the cam 60 have openings matching the rectangular section 46 so that they will turn with the handle 40. The cam 60 further includes a lug 62 which ensures proper orientation of the cam 60 on the handle rectangular section 46 when assembled. That is, as is typical in cam locks, the cam 60 includes a raised spiral cam flange 64 which in the open-locked position of the check rail lock is disposed within the interior space of the housing and which can be rotated with the handle 40 to an extended locking position engaging the keeper 12.

The locking member 55 includes a radially extending lug 66 at the lower end thereof. The cam 60 is suitably secured to the end of the handle rectangular section 46, as by forming a rivet on the end thereof, so as to bias the spring 56 upwardly against the locking member lug 66 which thereby applies a continuous upwardly biasing force to the lug 66.

The handle shaft 42 is rotatably mounted within an annular opening 70 in the top wall 24 of the housing 11. An annular shoulder 72 around the bottom of the annular opening 70 includes a pair of locking notches 74, 76, where the locking member lug 66 is biased by the spring 56 into one of the notches 74, 76 when aligned therewith. As will be recognized once a complete understanding of the present invention is obtained, the locking member lug 66 will be aligned with one of the notches 74 when the cam 60 is in the open position and with the other of the notches 76 when the cam 60 is in the locking position, and will ride on the bottom of the shoulder 72 when the handle is between the open and locking positions.

Preferably, the locking notches 74, 76 are radially oriented and substantially in alignment with one another to allow a range of rotation of the handle 40 and cam 60 of 180° between the open position and the locking position. Of course, a greater or lesser degree of motion could be provided if desired.

The housing 11 also has a pair of stop shoulders 80, 82 extending downwardly from the housing top wall 24, which shoulders 80, 82 coact with a stop member 84 on the upper surface of the cam 60 to stop rotation of the cam 60 at either of the extreme lock positions (that is, the open and locking positions). Of course, still other suitable structures for limiting the pivoting of the handle 40 could also be used within the scope of the present invention.

Thus, in either extreme lock position as limited by the stop shoulders 80, 82 and stop member 84, the locking member lug 66 is received in the associated locking notch 74 or 76. Further, each notch 74, 76 has a substantially vertical (that is, parallel to the axis of the handle shaft 42) side wall associated with a substantially vertical side wall of the locking member lug 66 such that any attempt to pivot the handle 40 with the lug 66 in one of the notches 74 or 76 will be prevented by the abutment of those surfaces. Of course, the notch and lug side walls could be oriented other than vertically so long as any pivoting force applied to the handle 40 does not tend to disengage the lug 66 from the associated notch 74 or 76 against the biasing force of the spring 56.

The check rail lock 10 shown in FIG. 4 is in the locking position in which the cam flange 64 is in a position to engage the keeper 12 when the window sashes are closed. The radially-extending lug 66 of the locking member 55 is biased upwardly by the spring 56 so as to be retained in the locking notch 74. Since the locking member 55 and handle 40 are rotatably fixed with respect to each other, the handle 40 cannot be rotated to release the check rail lock 10 from the locking or closed-locked position.

Figure 5:
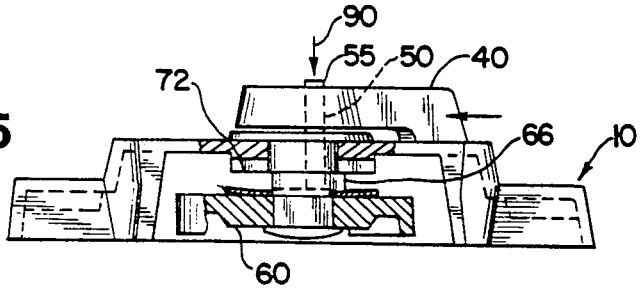
FIG. 5 is a partially broken elevation view of the check rail housing and associated structure with the cam in an intermediate position.

To move the handle 40 to the open position, a user must first press down (see arrow 90 in FIG. 5) on the upper end of the locking member 55 projecting through the handle opening 50 to overcome the biasing force of the spring 56 and thereby release the locking member lug 66 from the locking notch 74. With the radially-extending lug 66 below and clear of the locking notch 74, as best seen in FIG. 5, the handle 40 may be freely pivoted toward the open position. After first pivoting from the locking position, the user may release the downward force applied to the upper end of the locking member 55 and pivoting may continue with the locking member lug 66 riding on the annular shoulder 72 as previously mentioned.

When the handle 40 has been rotated 180°, the locking member lug 66 is aligned with the other locking notch 76 and is automatically biased into the notch 76 by the spring 56. The stop shoulder 80 and stop member 84 abut to prevent the handle 40 from being pivoted too far and to thereby ensure that the lug 66 will, in fact, engage the locking notch 76 to secure the lock 10 in the open or open-locked position.

It should now be understood that, in order to return the check rail lock 10 to the closed-locked position, a user depresses the locking member 55 and rotates the handle 40 in a direction opposite to the first direction until the locking member lug 66 is biased by the wave spring 56 into the other locking notch 74.

It should now be apparent that the above described check rail lock 10 can be easily and inexpensively manufactured and assembled. Still further, as the installation of the lock 10 is virtually identical to the well known installation of other check rail locks as are widely used in the market, installation of the locks 10 can also be accomplished quickly and easily as well.

Still further, the above described check rail lock 10 can be easily operated by an occupant of the dwelling at all times.

Also, such ideal operation is obtained with a lock which provides maximum security, as it is virtually impossible for an intruder to open the lock from its locking position from outside the window by manipulating a stiff wire or other tool between the window sashes. Where security grates or the like are secured to the window interiors, this makes it virtually impossible for an intruder to gain access through the window. Also, even for glass windows having no further security precautions, this lock still provides significant security by requiring that an intruder break a window to gain access. The mere fact that the intruder has no hope of gaining access without breaking the window is a strong deterrent against any such action, since most intruders are reluctant to make a noise (such as breaking the window) which could draw the dwelling occupant and result in a confrontation sought to be avoided by surreptitious intruders. Further, even if the intruder were so bold as to break the window to gain access, the resulting noise will serve as a warning to any occupants of the presence of such an intruder so that the occupants can take such steps as are possible to protect themselves, including simply to call for help.

Still further, the lock of the present invention is positively maintained in the open position as well to protect it from being inadvertently moved to an intermediate position with the cam 60 projecting from the housing 11. Thus, the cam 60 is securely maintained completely within the housing 11 when the windows are opened, and thus when the windows are thereafter moved there is no danger that the cam 60 might hit an obstruction such as the upper sash or a security grate on the upper sash. Thus, inadvertent damage to the cam lock 10 itself or to the upper sash or grate is avoided.

Still other aspects, objects, and advantages of the present invention can be obtained.

I claim:

1. In a check rail lock having a housing, a handle with a pivot shaft extending through the housing and secured for pivotal movement with respect to said housing, and said cam fixed for pivoting with said shaft, said handle and cam being pivotable together between an open position with the cam enclosed in the housing and a locking position with the cam extending from the housing for grasping a keeper, the improvement comprising:

an axially reciprocable locking member associated with said pivot shaft for pivoting therewith, said locking member having a manually engageable button end projecting above said housing and a locking end within said housing, said locking end having circumferentially spaced locking surfaces;

means for biasing said member locking end into engagement with said housing; and first and second locking notches in said housing for receiving said member locking end when said cam and handle are in the open and locking positions, respectively, said locking notches each having a surface engaging one of the locking end locking surfaces to prevent pivoting of said locking member and pivot shaft when said member locking end is received therein;

wherein said button end projects above said housing when said member locking end is engaged by either said first locking notch or said second locking notch.

2. The improved check rail lock of claim 1, wherein said locking end locking surfaces and said notch surfaces are each substantially parallel to the axis of rotation of said shaft.

3. The improved check rail lock of claim 1, wherein said biasing means is a spring washer between said cam and said locking member, and further comprising means for pivoting said spring washer with said cam

4. The improved check rail lock of claim 1, wherein said housing includes a mounting section boss defining a cylindrical opening receiving said shaft and associated locking member for pivoting therein, and said member locking end projects radially outwardly and is biased toward said mounting section.

5. The improved check rail lock of claim 1, further comprising an axial notch in said pivot shaft, wherein said locking member is received in said axial notch.

6. The improved check rail lock of claim 5, wherein said locking end locking surfaces and said notch surfaces are each substantially parallel to the axis of rotation of said shaft.

7. A check rail lock comprising:

a housing having first and second locking notches associated with an open-locked position and a closed-locked position, respectively;

a handle including a shaft rotatably received by said housing;

a cam connected to and rotatable with said shaft between the open-locked and the closed-locked positions;

means for locking said handle in said open-locked and said closed-locked positions, said locking means having a button end, a lower portion extending through an opening in said handle for independent axial movement and for rotary movement therewith, and a radially extending lug formed at an end of the lower portion, said lug being biased into said first and second locking notches when said handle is in said open-locked and closed-locked position, respectively; and a spring washer received in the shaft between said housing and said cam for rotation therewith, said washer biasing said locking means into said first and second locking notches when said handle is in said open-locked and closed-locked position, respectively;

wherein said button end is manually engageable to axially move the locking means against the bias of the spring washer to release the locking means and shaft from either said open-locked or said closed-locked positions; and wherein said button end projects above said housing when said lug is in either said first notch or said second notch.

8. The check rail lock of claim 7 wherein the spring washer is a concave wave spring.

9. The check rail lock of claim 7 wherein the shaft of the handle is received in a tubular section of the housing.

10. The check rail lock of claim 9 wherein the handle shaft includes a rectangular section having an axially-extending groove which defines first and second lugs, said locking means being slidably received in said axially-extending groove between said lugs and extending through said opening in said handle.

11. The check rail lock of claim 9, wherein said lug and said locking notches include surfaces which are substantially parallel to the axis of rotation of said shaft, one of said lug surfaces engaging one of the locking notch surfaces when received in either the first or second locking notch to prevent pivoting of said locking means and handle shaft when said handle is in said open-locked or closed-locked position, respectively.

12. The check rail lock of claim 9 wherein said first and second locking notches are formed in said tubular section.

13. The check rail lock of claim 12 wherein said tubular section includes a raised arcuate portion between said first and second locking notches, said radially extending lug of said locking means being slidably received on said raised arcuate portion to allow said handle to be rotated between said open-locked and said closed-locked positions.

14. A check rail lock comprising:

a housing including a tubular section having a raised arcuate portion between first and second locking notches associated with an open-locked position and a closed-locked position, respectively;

a handle including a shaft rotatably received in said tubular section of said housing, said handle including a rectangular section having an axially-extending groove which defines first and second lugs;

a cam connected to and rotatable with said shaft between the open-locked and the closed-locked positions;

means for locking said handle in said open-locked and said closed-locked positions, said locking means having a button end projecting outside said handle and a lower portion slidably engaged in the axially-extending groove for independent axial movement and for fixed rotary movement with the shaft; and a spring washer received on the shaft between said housing and said cam for rotation therewith, said washer biasing said locking means into said first and second locking notches when said handle is in said open-locked and closed-locked position, respectively;

wherein said button end is manually engageable to axially move the locking means against the bias of the spring to release the locking means and shaft from either said open-locked or said closed-locked positions, said locking means being slidably received on said raised arcuate portion when said handle is rotated between open-locked and said closed-locked positions.

15. A check rail lock comprising:

a housing having first and second locking notches associated with an open-locked position and a closed-locked position, respectively;

a handle including a shaft rotatably received by said housing, said shaft including a rectangular section having an axially-extending groove which defines first and second lugs;

a cam connected to and rotatable with said shaft between the open-locked and closed-locked positions;

means for locking said handle in said open-locked and said closed-locked positions, said locking means being slidably received in said axially-extending groove between said lugs and extending through said opening in said handle and having a button end extending through an opening in said handle for independent axial movement and for rotary movement therewith; and a spring washer received on the shaft between said housing and said cam for rotation therewith, said washer biasing said locking means into said first and second locking notches when said handle is in said open-locked and closed-locked position, respectively;

wherein said button end is manually engageable to axially move the locking means against the bias of the spring washer to release the locking means and shaft from either said open-locked or said closed-locked positions.

16. A check rail lock comprising:

a housing having first and second locking notches formed in a housing tubular section, said first and second notches associated with an open-locked position and a closed-locked position, respectively, said housing further including a raised arcuate portion between said first and second locking notches;

a handle including a shaft rotatably received in the tubular section of said housing;

a cam connected to and rotatable with said shaft between the open-locked and the closed-locked positions;

means for locking said handle in said open-locked and said closed-locked positions, said locking means having a button end and a lower portion extending through an opening in said handle for independent axial movement and for rotary movement therewith and further having a radially extending lug formed at an end thereof, said lug being biased into said first and second locking notches when said handle is in said open-locked and closed-locked position, respectively, said radially extending lug of said locking means being slidably received on said raised arcuate portion to allow said handle to be rotated between said open-locked and said closed-locked positions; and a spring washer received on the shaft between said housing and said cam for rotation therewith, said washer biasing said locking means into said first and second locking notches when said handle is in said open-locked and closed-locked position, respectively;

wherein said button end is manually engageable to axially move the locking means against the base of the spring washer to release the locking means and shaft from either said open-locked or said closed-locked positions.

* * * * *